US011419416B2

(12) United States Patent
Hayslett

(10) Patent No.: US 11,419,416 B2
(45) Date of Patent: Aug. 23, 2022

(54) REPOSITIONABLE HANDHELD EASEL

(71) Applicant: David Hayslett, Covington, VA (US)

(72) Inventor: David Hayslett, Covington, VA (US)

( * ) Notice: Subject to any disclaimer, the term of this patent is extended or adjusted under 35 U.S.C. 154(b) by 121 days.

(21) Appl. No.: 16/837,616

(22) Filed: Apr. 1, 2020

(65) Prior Publication Data

US 2021/0120955 A1 Apr. 29, 2021

Related U.S. Application Data

(60) Provisional application No. 62/924,987, filed on Oct. 23, 2019.

(51) Int. Cl.
*A47B 97/08* (2006.01)
*A47B 97/04* (2006.01)

(52) U.S. Cl.
CPC ..... *A47B 97/08* (2013.01); *A47B 97/04* (2013.01)

(58) Field of Classification Search
CPC ..... A47B 97/08; A47B 97/04; A47B 27/00; A47B 23/042; A47B 23/043; A47B 23/06044; A47B 23/00; A47B 23/004; A47B 23/06; A47B 23/044
USPC ..... 248/441.1, 444, 447, 447.1, 460, 461, 248/462, 458, 451, 446, 464, 448
See application file for complete search history.

(56) References Cited

U.S. PATENT DOCUMENTS 155,202 A * 9/1874 Nutting ..... A47B 23/042 248/454
226,139 A * 3/1880 Wilkins, Jr. ..... A47B 23/043 248/456
340,987 A * 5/1886 De Voe ..... A47B 23/042 248/455
743,678 A * 11/1903 Bear ..... A47B 23/042 248/452
1,071,428 A * 8/1913 Jones ..... A47B 23/042 248/448
1,305,853 A * 6/1919 Widmer ..... A47B 23/002 248/444
1,401,458 A * 12/1921 Boon ..... A47B 27/02 248/456
1,504,826 A * 8/1924 Larsen ..... G09F 1/12 40/716
1,900,250 A * 3/1933 Mitchell ..... A47B 27/02 108/4
1,902,175 A * 3/1933 Lurie ..... A47B 27/02 16/341
2,353,625 A * 7/1944 Moore ..... A47G 1/14 40/603
2,501,019 A * 3/1950 Purdye ..... A47B 23/043 248/448
2,611,427 A * 9/1952 Leo ..... G03B 21/58 160/329

(Continued)

*Primary Examiner* — Nkeisha Smith
(74) *Attorney, Agent, or Firm* — Brennan, Manna & Diamond, LLC

(57) ABSTRACT

The present invention relates generally to a repositionable and handheld easel of lightweight composition, and that is removably attachable to a painting canvas frame without interfering with any paintable portion of the canvas. The handheld easel is also adjustable in size to accommodate virtually any size of handheld canvas frame, and allows the painting surface to be rotated in relation to the artists hand to enable the artist to achieve a specific brush stroke while the handheld easel remains in the artist's hand.

2 Claims, 7 Drawing Sheets

(56) References Cited

U.S. PATENT DOCUMENTS 2,743,550 A * 5/1956 Felice ..... A47B 23/043 248/457
3,514,173 A * 5/1970 Ford ..... B44D 3/04 312/231
3,991,967 A * 11/1976 Sack ..... A47B 23/043 248/448
4,058,066 A * 11/1977 Altman ..... A47B 27/02 108/9
4,285,532 A * 8/1981 Davis ..... B42D 9/008 248/451
4,643,384 A * 2/1987 Guerin ..... A47B 97/04 248/449
4,690,363 A * 9/1987 Koves ..... A47B 97/08 248/163.1
5,365,682 A * 11/1994 Eubank, Jr. ..... A47G 1/0644 40/746
5,690,310 A * 11/1997 Brown ..... A47B 23/043 248/444.1
5,725,192 A * 3/1998 Cloninger ..... A47B 97/04 248/447
7,510,215 B2 * 3/2009 Lee ..... A45F 5/12 248/451
8,413,943 B1 * 4/2013 Li ..... F16M 11/10 248/454
8,616,423 B2 * 12/2013 Wizikowski ..... F16M 13/04 224/218
9,198,507 B1 * 12/2015 Lau ..... F16M 11/2021
9,420,712 B2 * 8/2016 Yang ..... F16M 11/38
10,463,152 B1 * 11/2019 Day ..... A47B 27/02
10,813,451 B2 * 10/2020 Hill ..... B60N 3/001
2003/0173488 A1 * 9/2003 Cook ..... A47B 97/08 248/458
2009/0140119 A1 * 6/2009 To ..... F16M 11/041 248/455
2013/0134284 A1 * 5/2013 Hu ..... F16M 11/10 248/451
2014/0326846 A1 * 11/2014 Selwa ..... A47B 97/04 248/448
2014/0328020 A1 * 11/2014 Galant ..... G06F 21/88 361/679.56
2016/0108942 A1 * 4/2016 Yu ..... F16M 13/00 248/316.4

* cited by examiner

REPOSITIONABLE HANDHELD EASEL

CROSS-REFERENCE TO RELATED APPLICATION

The present application claims priority to and the benefit of U.S. Provisional Application No. 62/924,987 filed on Oct. 23, 2019, which is incorporated herein by reference in its entirety.

BACKGROUND

The present invention relates generally to a repositionable and handheld easel. More specifically, the invention relates to a handheld easel device that is preferably comprised of aluminum or other lightweight metal or composition, and that is removably attachable to the backside of a frame of a painting canvas and is held in place through compressive forces. More specifically, the forces used to hold the handheld easel device in place relative to the canvas frame are generated by a user, such as an artist, repositioning a tension handle on a tensioning apparatus which in turn repositions a plurality of members and hinged arm members. The handheld easel device is further comprised of a handle assembly and face plate that allows the user to reposition the painting surface radially in relation to the user's hand to, for example, achieve a specific brush stroke or paint a portion of the canvas while the easel device remains in the user's hand. Accordingly, the present specification makes specific reference thereto. However, it is to be appreciated that aspects of the present invention are also equally amenable to other like applications, devices and methods of manufacture.

In the art of painting, many artworks are created while the artist references a subject, and in the case of artists who create landscape works, said subject may be a natural feature that occurs in an outdoor space, remote area, or other natural setting. Once an artist has elected to create his or her work in such a location, the artist must transport his or her equipment to said location and then procure a means to secure the canvas to an easel or other canvas support to complete the painting.

In a given situation, many artists may choose to utilize a traditional three-legged wooden easel to support and secure their canvas for painting. However, in applications involving landscape painting or any other type of painting that doesn't occur in a controlled or studio environment, existing three-legged wooden easels contain a number of inherent limitations that prohibit their use in such settings and/or applications.

By way of example and not limitation, the usage of existing three-legged easels are typically limited in their application to an area that is comprised of enough flat surface to permit all three legs of the easel to rest evenly on the ground surface. Unfortunately, many outdoor locations amenable to being painted do not also comprise a sufficiently large flat surface for evenly supporting a three legged easel. Further, an unsecure or unstable three legged easel could result in the easel and/or painting becoming knocked over and/or otherwise damaged. For example, the application of an artist's brush to an unsecure or unstable canvas may be a sufficient enough force to knock the same over and ruin the painting and/or the easel.

Additionally, most traditional three legged easels are comprised of arms or other structures that touch or contact one or more of the top, bottom and/or side surfaces of the canvas. As such, said arms may interfere with the paintable surfaces of the canvas, thereby limiting the artist's ability to fully express him or herself and prevent the artist from utilizing the full extent of the canvas available to be painted upon.

Further still, existing three-legged art easels can be large, heavy and difficult to transport to remote locations where an artist may wish to paint. Additionally, even when the artist is able to transport the easel to the remote location, the artist may be sufficiently fatigued and therefore no longer wish to paint, or may face the other above referenced limitations associated with traditional three legged easels. Existing easels also lack the ability for the artist to easily reposition or rotate the canvas to achieve, for example, a particular brush stroke or reach the far end of the paintable surface.

Therefore, there exists in the art a long felt need for a handheld easel of lightweight composition that is relatively easy to transport and set-up, and that is not dependent on the presence of a sufficient amount of flat ground or area to rest upon. There is also a long felt need in the art for a handheld easel that is removably attachable to a painting canvas frame without interfering with any paintable portion of the canvas. Additionally, a long felt need in the art exists for a handheld easel that is adjustable in size to accommodate virtually any size of handheld canvas frame. Finally, there exists in the art a long felt need for a handheld easel that allows the painting surface to be rotated in relation to the artist's hand to enable the artist to, for example, achieve a specific brush stroke while the handheld easel remains in the artist's hand or reach the far end of the paintable surface.

The present invention, in one exemplary embodiment, discloses an adjustable and repositionable handheld easel of lightweight composition. More specifically, the handheld easel device is preferably comprised of a pair of threaded support arm rods and perpendicularly angled feet that allow the easel device to be removably secured to the canvas frame on the rear or backside of a painting canvas, and without interfering with any portion of the paintable canvas surface. Compressive forces are applied to the easel device via a tensioning apparatus that is comprised of two spaced apart members, a pair of hinged arm members, a hinge bolt, and a tension handle. Further, a face plate is secured to the tensioning apparatus via a plurality of locking pins and a handle assembly that is pivotally attached to the face plate via a rotating pin connection. More specifically, the face plate is comprised of a plurality of pin holes to which a pin on the handle assembly can be dropped into to lock the handle assembly in any number of angled positions along the face plate, thereby allowing the user to rotate the canvas that the handheld easel device is secured to relative to the user's hand.

In this manner, the improved and repositionable handheld easel device of the present invention accomplishes all of the forgoing objectives. More specifically, the handheld easel device of the present invention allows a user to paint in any environment while overcoming all of the inherent limitations associated with existing three-legged easel mentioned above including, without limitation, the need for a minimum amount of flat ground to support the three easel legs and the easel's interference with otherwise paintable canvas area. In addition, the handheld easel device of the present invention can be sized to accommodate virtually any size of handheld painting canvas frame, as is rotatable about the user's hand to aid the user in making difficult brushstrokes and/or reaching hard to reach locations on the canvas.

SUMMARY

The following presents a simplified summary in order to provide a basic understanding of some aspects of the disclosed innovation. This summary is not an extensive overview, and it is not intended to identify key/critical elements or to delineate the scope thereof. Its sole purpose is to present some concepts in a simplified form as a prelude to the more detailed description that is presented later.

The subject matter disclosed and claimed herein, in one embodiment thereof, discloses an adjustable and rotatable handheld easel comprised of a tensioning apparatus, a pair of support arm rods each extending outwardly from said tensioning apparatus in generally opposite directions, a foot attached to each of said pair of support arm rods for removably engaging a canvas frame, a handle assembly, a face plate and a locking pin. The tensioning apparatus is further comprised of a first member, a second member, a hinge bolt, a pair of hinge arms and a tension handle that are capable of applying an outwardly compressive force to each of said support arms, the feet attached thereto and, ultimately, the opposing frame members themselves. Additionally, the handle assembly is rotatable about the face plate to enable a user, such as an artist, to rotate the canvased frame about the handle to, for example, achieve a particular brush stroke, and the handle assembly may be secured to the face plate in a desired position via the locking pin.

The handheld easel device of the present invention and its various components are preferably comprised of a lightweight aluminum or other suitable material to make for easily handling and so as to not fatigue the arm of the artist that supports the handheld easel. To removably attach the handheld easel to a frame, such as a wooden frame on the backside of a painting canvas, a user must first select the appropriate length of support arm rods to use to, along with the length of tensioning apparatus, span the length between opposing frame members of the canvas frame.

Once an appropriate selection has been made, the support arm rods may be threaded into the outboard side of each of the first member and the second member of the tensioning apparatus, preferably while the tensioning apparatus is in an unlocked or disengaged position, as explained more fully below. The opposite end of each of support arm rods are also threaded into a foot or other frame engaging member. Once each of support arm rods are threaded into both components and the handheld easel device is positioned between two opposing frame members, a user can rotate the tension handle in the general direction of the second member and into the locked or engaged position, thereby causing each of the pair of hinge arms to be repositioned into a generally horizontal position (i.e., 180 degrees) relative to the first and second members. As this occurs, the distance between the first member and the second member will increase and a compressive force will be applied to the opposing frame members by each of the support arm rods and feet attached thereto, and the handheld easel device will be removably secured to the frame.

Once the handheld easel has been removably secured to the canvas frame, the face plate (with attached handle assembly) can be installed over top of the tensioning apparatus such that the locking pin openings therein align with the locking pin openings of the tensioning apparatus, and the device can be locked in the engaged position via a pair of locking pins inserted through the aligned locking pin openings.

The handle assembly of the handheld easel of the present invention is comprised of a handle body that is fixed (e.g., by a weld) to a handle plate. In turn, the handle plate is secured to the face plate via a plate pin that is secured through a continuous plate pin opening in the handle plate and a continuous plate pin opening in the face plate. The plate pin allows the handle assembly to move radially in relation to the surface of the face plate. The angle/position of the handle assembly relative to the face plate can then be chosen by the user by inserting the repositioning pin into a selected one of the plurality of openings in the face plate to lock the handle assembly in a desired position. In this manner, the user may rotate the entirety of the paintable canvas surface relative to its hand, for example, to aid in making difficult brushstrokes.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and is intended to include all such aspects and their equivalents. Other advantages and novel features will become apparent from the following detailed description when considered in conjunction with the drawings.

DETAILED DESCRIPTION

Figure 1:
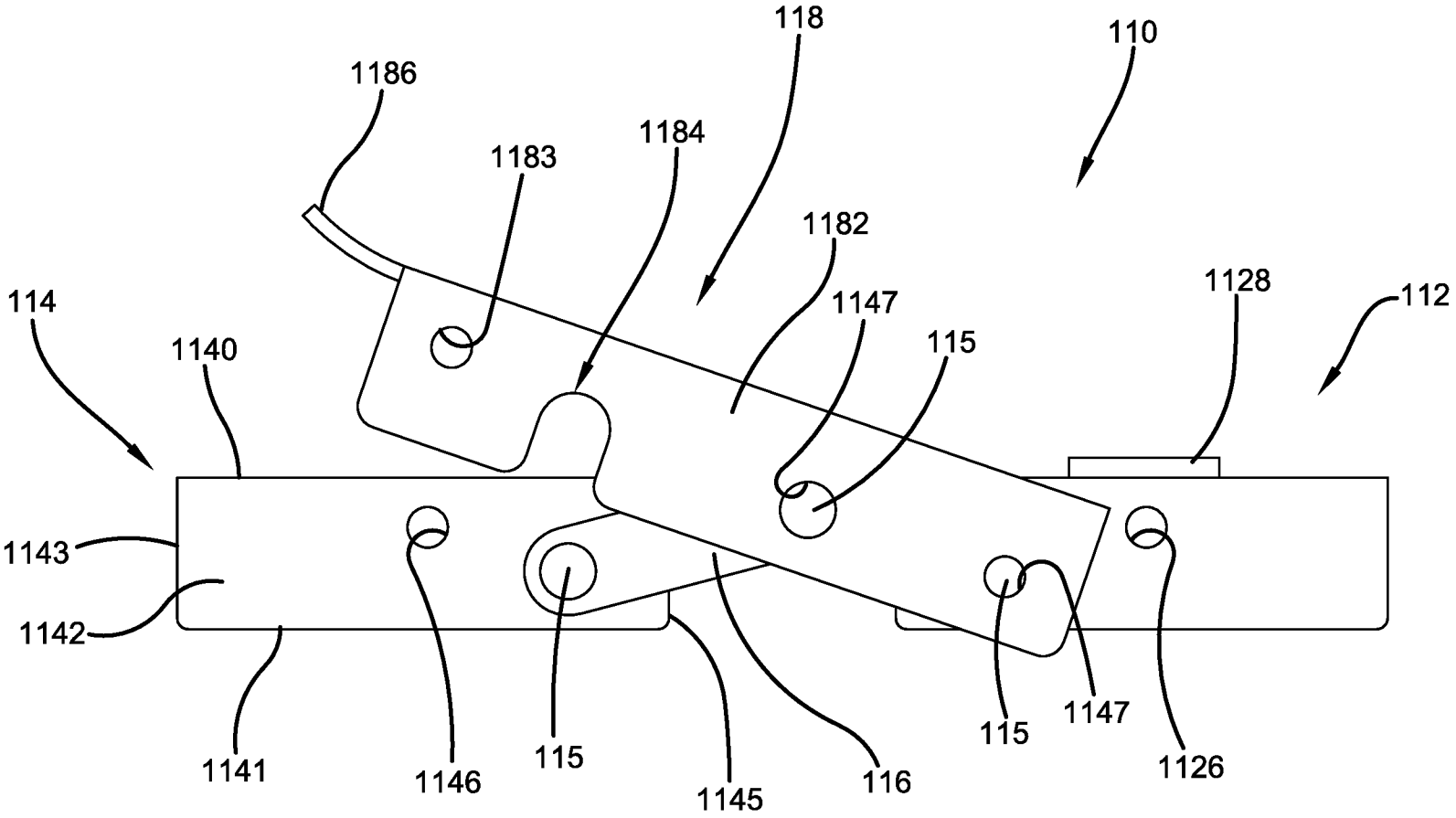
FIG. 1 illustrates a side perspective view of one potential embodiment of the tensioning apparatus of the rotatable handheld easel device of the present invention in an unlocked or un-tensioned position and in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof.

As noted above, there exists in the art a long felt need for a handheld easel of lightweight composition that is relatively easy to transport and set-up, and that is not dependent on the presence of a sufficient amount of flat ground area to rest on as is the case with prior art three legged easels. There is also a long felt need in the art for a handheld easel that is removably attachable to a painting canvas frame without interfering with any paintable portion of the canvas, thereby enabling the artist to utilize the entire paintable surface by which to express him or herself, and that is adjustable in size to accommodate virtually any size of handheld canvas frame. Finally, there exists in the art a long felt need for a handheld easel that allows the painting surface to be rotated in relation to the artist's hand to enable the artist to, for example, achieve a specific brush stroke or to reach a hard to reach location on the canvas.

The adjustable and rotatable handheld easel 100 of the present invention accomplishes all of the forgoing objectives and is preferably comprised of a tensioning apparatus 110, a pair of support arm rods 140, a foot 150 attached to each of said pair of support arm rods 140, a handle assembly 160, a face plate 170 and a locking pin 180. Unless otherwise stated herein, the handheld easel device 100 of the present invention and its various components are preferably comprised of a lightweight aluminum or other suitable material to make for easily handling, and so as to not fatigue the arm of the artist that supports the handheld easel 100, as he or she may be required to do so for a prolonged period of time to complete a particular painting.

Figure 2:
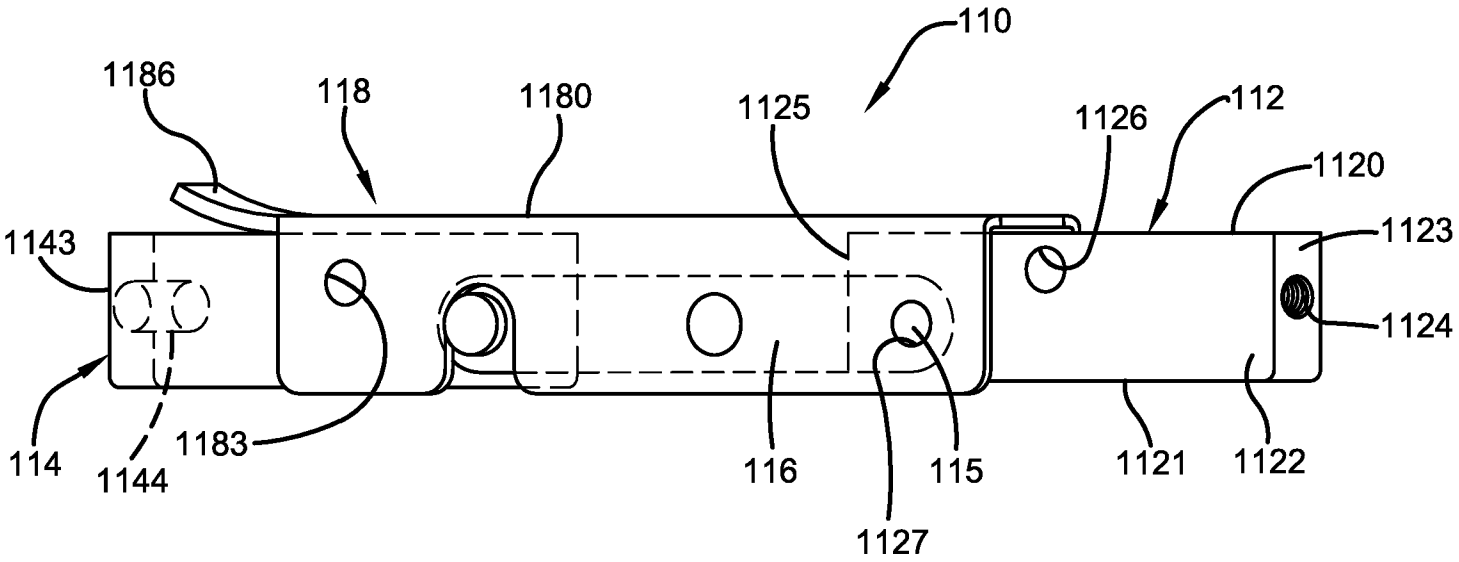
FIG. 2 illustrates a side perspective view of one potential embodiment of the tensioning apparatus of the rotatable handheld easel device of the present invention in a locked and tensioned position in accordance with the disclosed architecture.

Referring initially to the drawings, FIG. 1 illustrates a side perspective view of one potential embodiment of the tensioning apparatus 110 of the rotatable handheld easel device 100 of the present invention in an unlocked or un-tensioned position. The tensioning apparatus 110 is comprised of a first member 112, a second member 114, a pair of hinge bolts 115, a pair of hinged arms 116 and a tension handle 118. As best shown in FIGS. 1 and 2 and explained more fully below, each of the first member 112, the second member 114 and the tension handle 118 are movably interconnected to one another by the pair of hinged arms 116 via the pair of hinge bolts. It should be noted that the first member 112 and second member 114 are generally mirrored in their orientation, yet substantially similar (if not identical) in their composition and features.

More specifically, the first member 112 is generally rectangular in shape, and is further comprised of a top surface 1120, an opposed bottom surface 1121, two generally parallel side surfaces 1122, a first end 1123 and an opposed second end 1125. As best shown in FIG. 2, the first end 1123 is further comprised of a threaded opening 1124 therein for receipt of a select end of the support arm rod 140, as explained more fully below. The first member 112 is further comprised of a continuous locking pin opening 1126 for receipt of locking pin 180 and a continuous bolt hinge opening 1127 for receipt of hinge bolt 115, both of which extend between side surfaces 1122 of the first member 112.

Similarly, the second member 114 is also generally rectangular in shape, and is further comprised of a top surface 1140, an opposed bottom surface 1141, two generally parallel side surfaces 1142, a first end 1143 and an opposed second end 1145. As best shown in FIGS. 1 and 2, the first end 1143 is further comprised of a threaded opening 1144 therein for receipt of a select end of the support arm rod 140, as explained more fully below. The second member 114 is further comprised of a continuous locking pin opening 1146 for receipt of locking pin 180 and a continuous bolt hinge opening 1147 for receipt of hinge bolt 115, both of which extend between side surfaces 1142 of the second member 114.

As best shown in FIGS. 1 and 2, the tension handle 118 is preferably comprised of a top surface 1180 and two generally parallel and spaced apart sides surfaces 1182 extending downwardly therefrom. The top surface 1180 is also comprised of a handle portion 1186 that extends outwardly from the top surface 1180 beyond the ends of side surfaces, and is generally contoured to oppose the contour of the palm of a user/artist (not shown) to aid the user in placing the tensioning apparatus 110 of the handheld easel device 100 into a locked or tensioned position, as best shown in FIG. 2.

Additionally, the side surfaces 1182 of tension handle 118 are further comprised of a continuous locking pin opening 1183 for receipt of locking pin 180. It should be noted that the locking pin opening 1183 of the side surface 1182 aligns generally with the locking pin opening 1146 of the second member 1142 to allow for the locking pin 180 to be placed through both openings 1183/1146, thus effectively securing the tension handle 118 in a locked or tensioned position, as best shown in FIG. 2. Each of the side surfaces 1182 of tension handle 118 further comprise a pair of continuous bolt hinge openings 1147 for receipt of hinge bolts, as best shown in FIG. 1, and a slot 1184 that allows for clearance of the hinge bolt 115 that secures the pair of hinge arms 116 to the second member 114, as also shown in FIG. 1 and explained more fully below. It is also contemplated that a fixed or removable spacer 1128 may be positioned on the respective top surface 1120, 1140 of the first and/or or second members 112, 114 to allow for clearance of the repositioning pin 1710, as explained more fully below.

Figure 6:
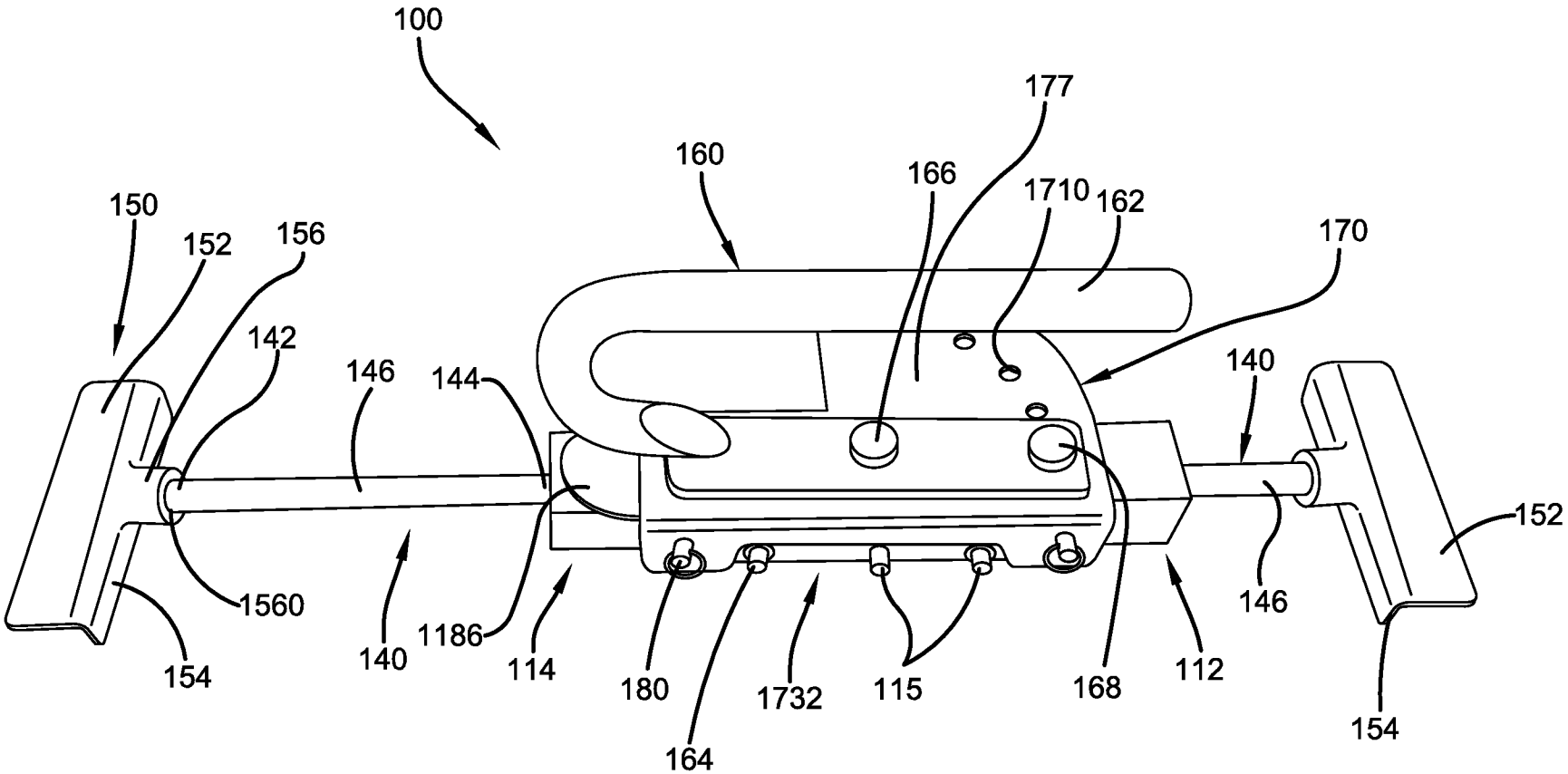
FIG. 6 illustrates a perspective view of one potential embodiment of the rotatable handheld easel device of the present invention in a locked and tensioned position in accordance with the disclosed architecture.
Figure 7:
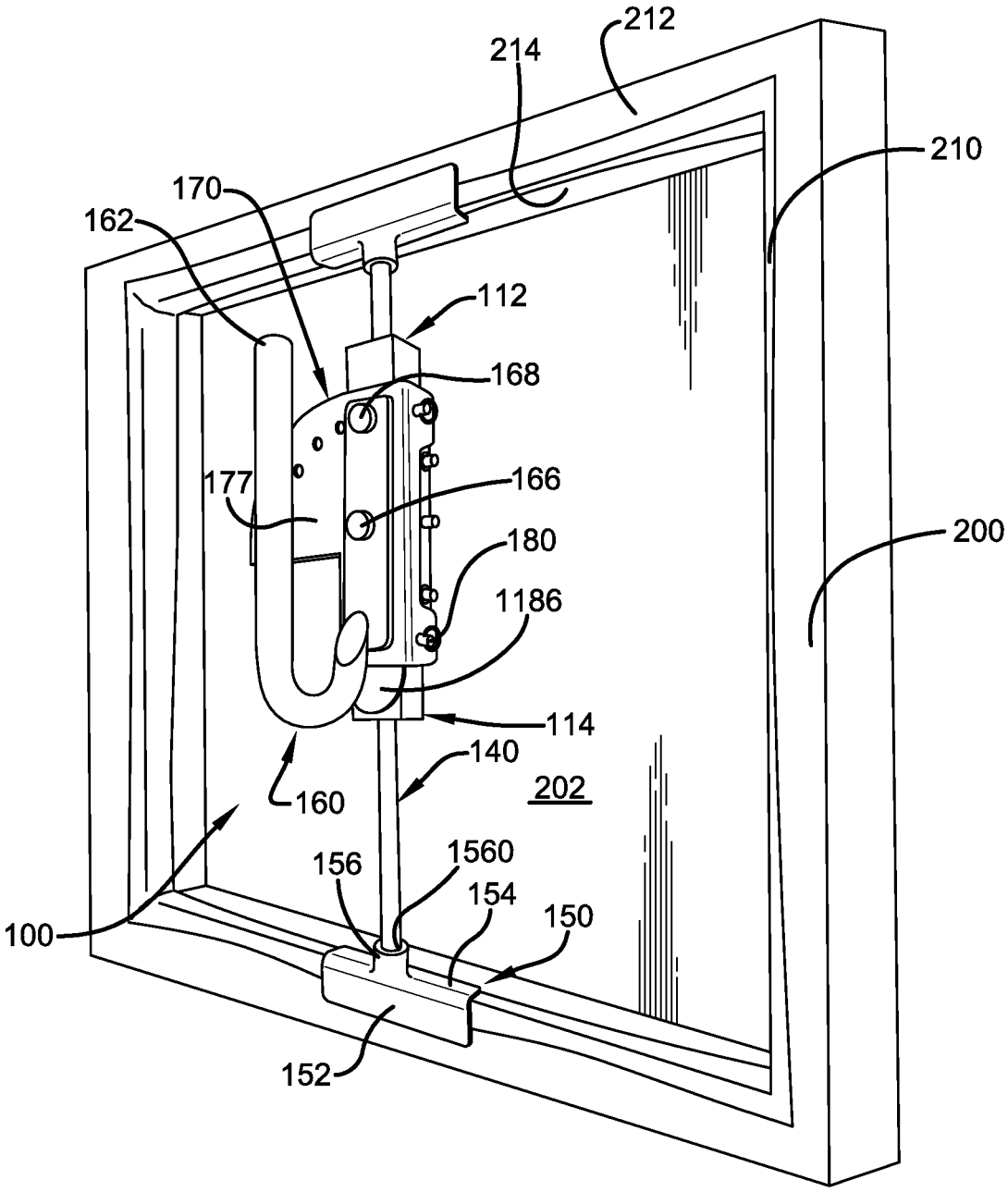
FIG. 7 illustrates a perspective view of one potential embodiment of the rotatable handheld easel device of the present invention removably attached to a canvas frame in accordance with the disclosed architecture.

In order to form the tensioning apparatus 110, the spaced apart hinge bolts 115 of second member 114 and tension handle 118 are connected via the hinge arms 116 that are found on each side of the tensioning apparatus 110. The hinge arms 116, as well as the presence of hinge bolt 115 in first member 112, permit the tension handle 118 to articulate or rotate about hinge bolt 115 in first member 112. This rotation primarily occurs between an un-tensioned position (as best shown in FIG. 1) and a tensioned or locked position (as best shown in FIGS. 2, 6 and 7), once the user pushes on the handle portion 1186 of tension handle 118 in the direction of second member 114. As this occurs, the pair of hinged arms 116 push both first and second members 112, 114 (and the support arm rods 140 and feet 150 connected thereto, as explained more fully below) outwardly and away from one another. As explained more fully below, this act of further separating first and second members 112, 114 will, in turn, cause the support arm rods 140 and feet 150 to apply a compressive force against two opposing frame members of canvas frame 210, as best shown in FIG. 7.

Figure 3:
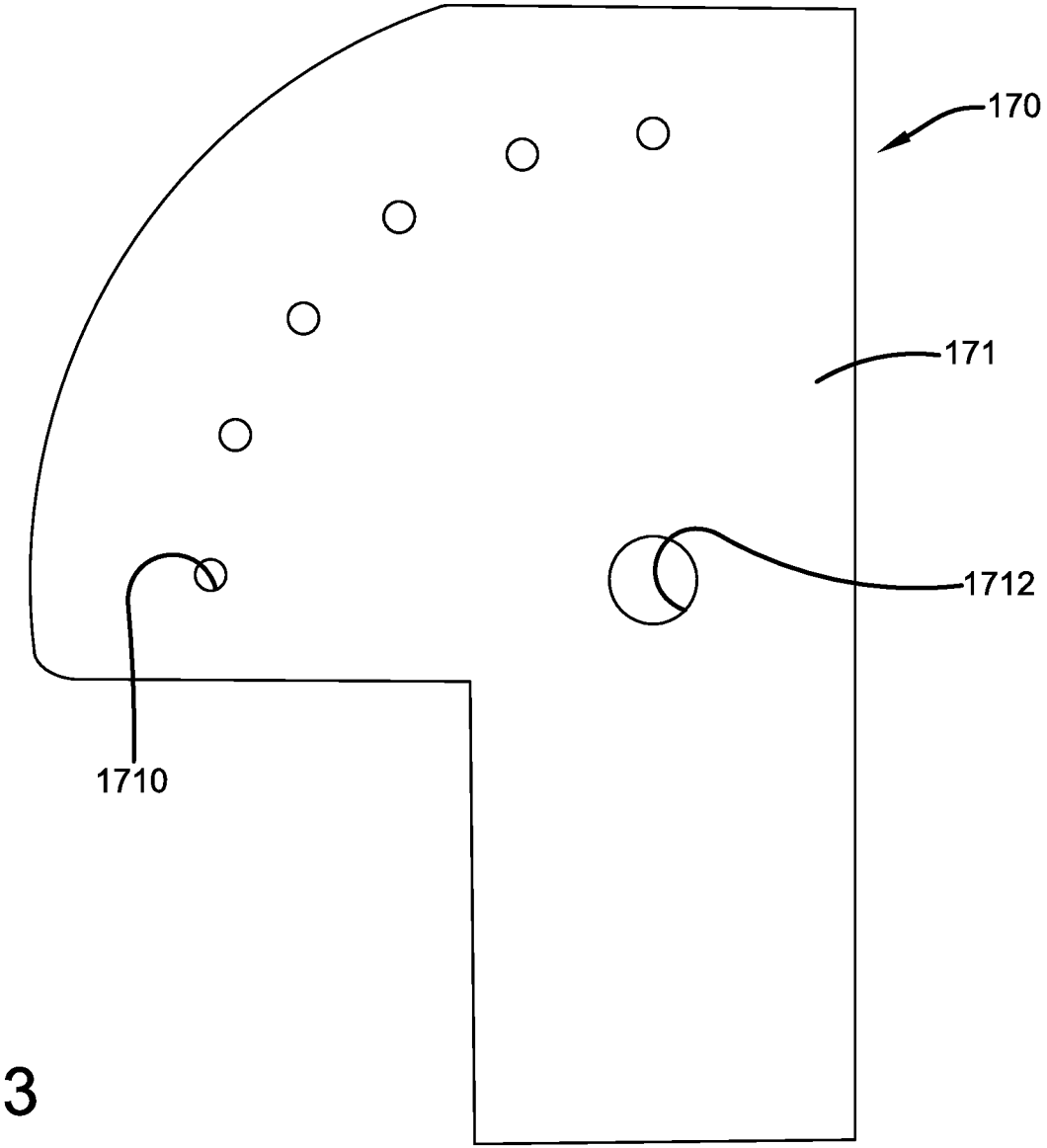
FIG. 3 illustrates a top perspective view of one potential embodiment of the face plate of the rotatable handheld easel device of the present invention in accordance with the disclosed architecture.

FIG. 3 illustrates a top perspective view of one potential embodiment of the face plate 170 of the handheld easel device 100 of the present invention. The face plate 170 is preferably comprised of a top surface 171, an opposed bottom surface 172, a first side support 173, a second side support 174, a channel 175, a third side support 176 and a generally radial plate 177. The face plate 170 is further comprised of a plurality of continuous repositioning pin openings 1710 that extend from the top surface 171 to the bottom surface 172. The pin openings 1710 are meant for selective receipt of repositioning pin 168, and are positioned along the top surface 171 in an incremented and radial fashion to allow for the handle assembly 160 to be positioned at a selectable angle relative to the face plate 170. Additionally, the face plate 170 is also comprised of a continuous plate pin opening 1710 that extends between the top surface 171 and bottom surface 172 for receipt of a pivoting plate pin 166, as will be explained in greater detail below when referencing FIGS. 5, 6, and 7.

Figure 4:
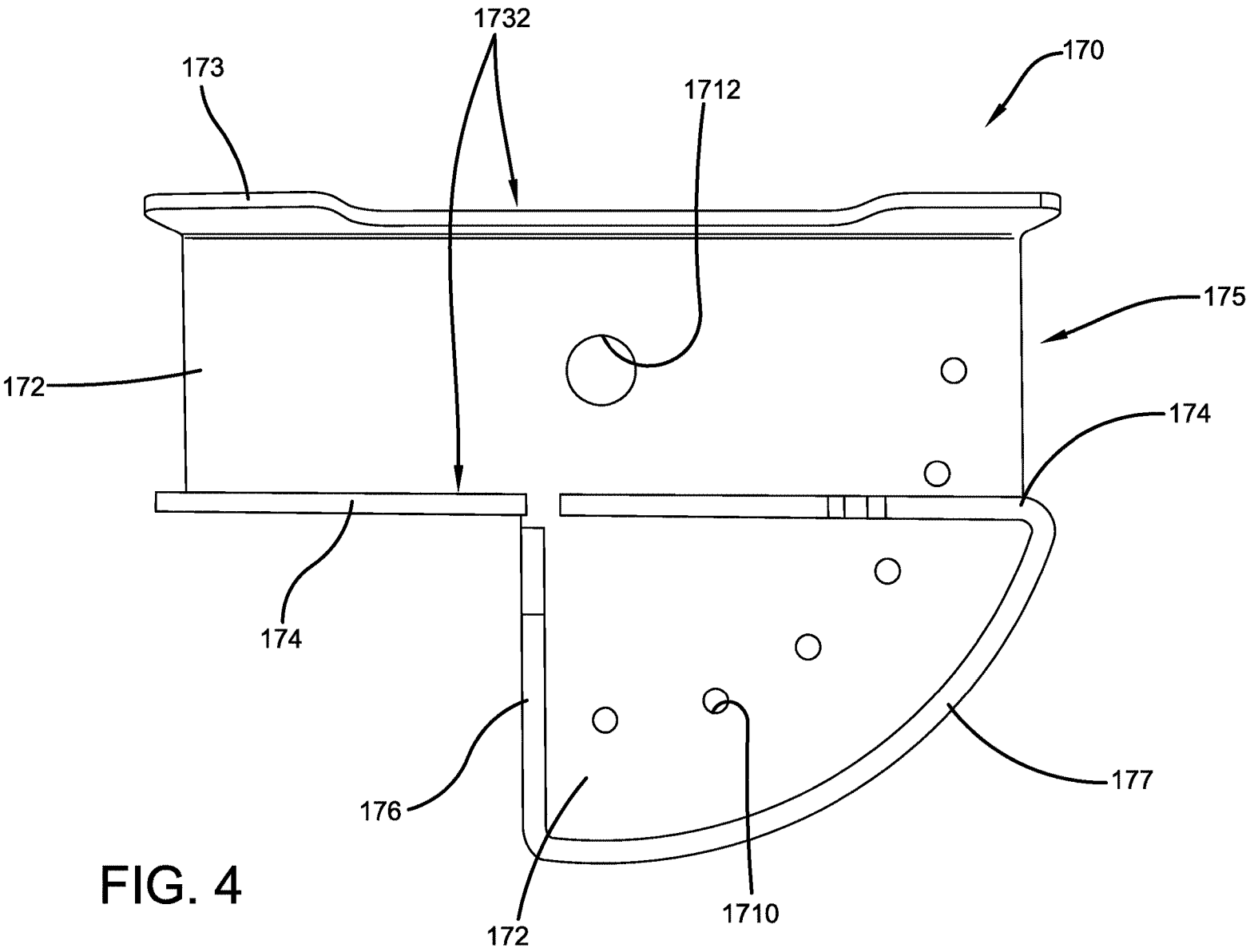
FIG. 4 illustrates a bottom perspective view of one potential embodiment of the face plate of the rotatable handheld easel device of the present invention in accordance with the disclosed architecture.

FIG. 4 illustrates a bottom perspective view of one embodiment of face plate 170, and better illustrates the presence of first side support 173, second side support 174, third side support 176, and radial support plate 177, all of which extend outwardly and away from bottom surface 172 of face plate 170. More specifically, first side support 173 is generally parallel to, and spaced apart from, second side support 174 and, together with bottom surface 172, form channel 175. Additionally, each of first side support 173 and second side support 174 is comprised of a slot 1732 that allows for clearance of the hinge bolts 115 once the tensioning apparatus 110 is placed within channel 175 in a tensioned or locked position. The third side support 176 and radial support plate 177, along with the first and second side supports 173, 174, are preferably fixedly connected (e.g., via a weld) to the bottom surface 172 of the face plate 170, and the third side support 176 and radial support plate 177 provide structural reinforcement for the face plate 170.

Figure 5:
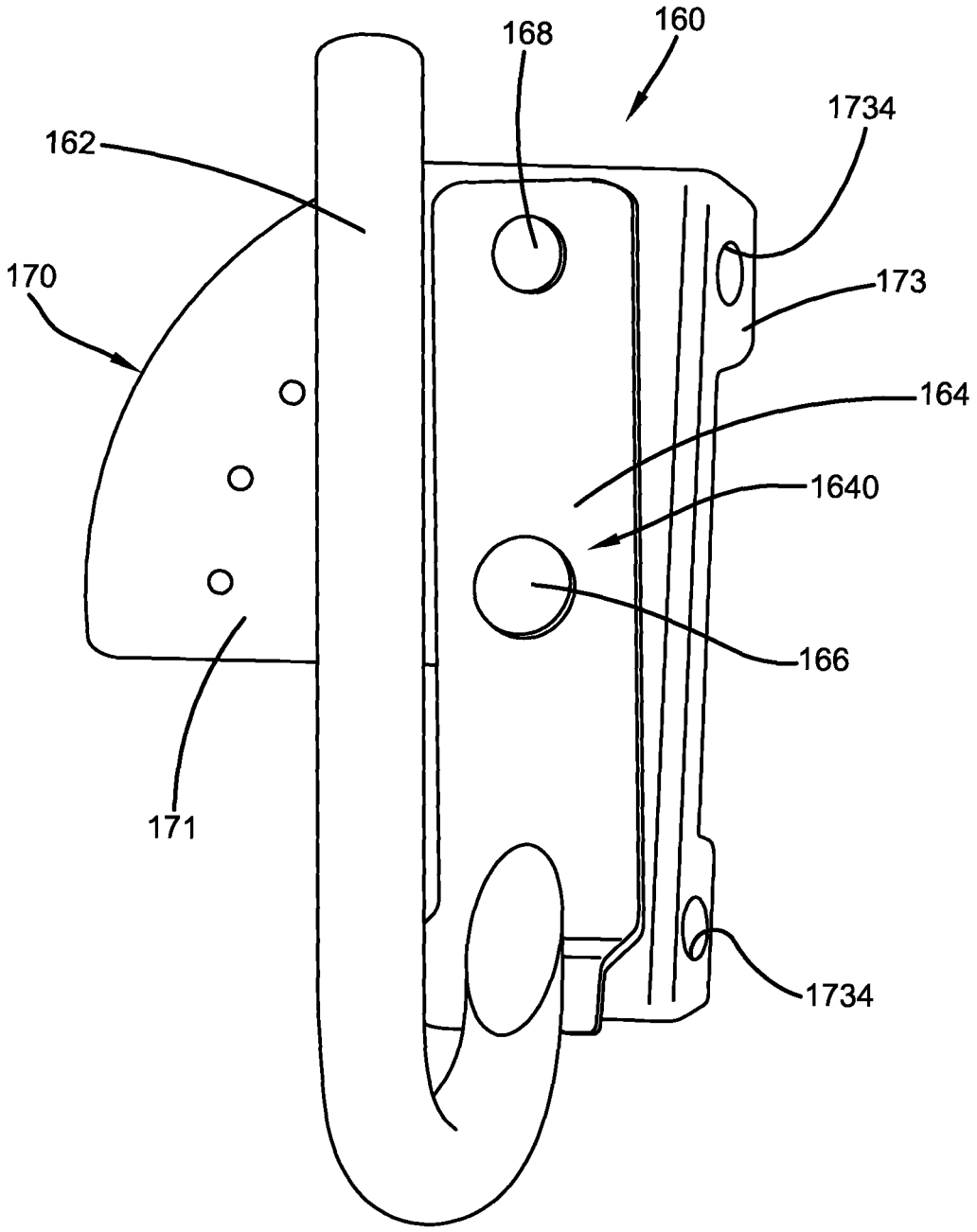
FIG. 5 illustrates a top perspective view of one potential embodiment of the face plate and handle assembly of the rotatable handheld easel device of the present invention in accordance with the disclosed architecture.

FIG. 5 illustrates a top perspective view of one potential embodiment of the handle assembly 160 rotatably attached to the face plate 170 of the handheld easel device 100 of the present invention. The handle assembly 160 is preferably comprised of a handle 162, a handle plate 164, a continuous plate pin opening 1640 in handle plate 164, a plate pin 166, and a repositioning pin 168. The handle 162 is preferably fixed to the handle plate 164 via a fixed connection (e.g., via a weld), and may be shaped or formed in such a way to form a generally U-shape with handle plate 164, as best shown in FIG. 5. The handle 162 allows a user/artist to comfortably grasp the handheld easel device 100 while the same is removably attached to canvas frame 210 without becoming unduly fatigued.

The continuous plate pin opening 1640 in handle plate 164 generally aligns with the plate pin opening 1712 of the face plate 170 to allow the insertion of the plate pin 166. The handle assembly 160 is capable of rotating about plate pin 166 until a user/artist selectively inserts the repositioning pin 168 in a select one of repositioning pin openings 1710 in face plate 170. More specifically, to secure the handle assembly 160 into a new position relative to face plate 170, the repositioning pin 168, which is retained within the handle plate 164 but is able to be lifted, is lifted upwards away from the top surface 171 of the face plate 170. Then, the user rotates the handle assembly 160 about the plate pin 166 until the repositioning pin 168 aligns with a selected one of the repositioning pin openings 1710 in the face plate 170. Once the user has selected the angle of rotation that he or she desires and ensures proper alignment with the desired repositioning pin opening 1710, the user will simply release the repositioning pin 168 (which may be spring loaded) and the repositioning pin 168 will travel downwards through the continuous pin opening 1710 where the tip of the pin 168 will extend beyond that of the bottom surface 172 of the face plate 170. This repositioning procedure effectively locks the handle assembly 160 in the desired position relative to face plate 170, allowing the handheld easel device 100 to be held by a user without fear of the handle assembly 160 shifting in position/alignment during use.

FIG. 6 illustrates a perspective view of one embodiment of the rotatable handheld easel device 100 of the present invention when fully assembled. More specifically, FIG. 6 illustrates how the handle assembly 160, which is mounted to the face plate 170, sits atop the tensioning apparatus 110 while in a locked or tensioned position via the locking pins 180. As mentioned supra, the locking pins 180 are placed through the various continuous locking pin openings 1126/1146/1183/1734 in the first member 112, second member 114, tension handle 118, and face plate 170, which are all in general alignment.

As also shown in FIG. 6, each of support arm rods 140 are preferably comprised of threaded first and second ends 142, 144, and a body portion 146 positioned therebetween. Likewise, each of feet 150 are preferably comprised of a top 152, a side 154, and a pocket member 156 with a threaded opening 1560 therein for receipt of a first or second end 142, 144 of support arm rod 140. More specifically, pocket member 156 extends outwardly from side 154 in the direction of tensioning apparatus 110, and the two are connected to one another by support arm rod 140, as best shown in FIGS. 6 and 7. It will be appreciated that the support arm rods 140 can be manufactured in various sizes and lengths to accommodate virtually any size of canvas frame 210.

FIG. 7 illustrates a perspective view of one embodiment of the repositionable handheld easel device 100 of the present invention removably attached to a canvas frame 210 that is attached to a canvas 200. More specifically, the canvas is comprised of a bottom surface 202, and frame 210 is comprised of a plurality of interconnected frame members that each have a bottom face 212 and a side face 214 and that generally form a rectangle as best shown in FIG. 7.

In this orientation, the tensioning apparatus 110 of the handheld easel device 100 is in the locked position and is applying compressive forces against the side faces 214 of the opposing frame members via support arm rods 140 and feet 150 to removably attach the handheld easel device 100 to the frame 210 without interfering with any of the paintable surfaces of canvas 200. More specifically, it is to be appreciated that, at any time, the feet 150 are the only portion of the handheld easel device 100 that is in physical contact with any part of the frame 210. Additionally, the user/artist may reposition the face plate 170, and therefore the entire canvas 200, relative to the handle assembly 160 and the user's hand (not shown) to, for example, achieve a particular brush stroke and/or more easily paint a specific portion of canvas 200.

Notwithstanding the forgoing, the rotatable handheld easel device 100 can be any suitable size, shape, and configuration as is known in the art without affecting the overall concept of the invention, provided that it accomplishes the above stated objectives. One of ordinary skill in the art will appreciate that the shape and size of the handheld easel device 100 and its various components, as shown in the FIGS. are for illustrative purposes only, and that many other shapes and sizes of the handheld easel device 100 are well within the scope of the present disclosure. Although dimensions of the handheld easel device 100 and its components (i.e., length, width, and height) are important design parameters for good performance, the handheld easel device 100 and its components may be any shape or size that ensures optimal performance during use and/or that suits user need and/or preference.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. An easel device for attachment to a frame supporting a canvas, wherein the easel device comprises:

a tensioning apparatus comprised of a first member, a second member, a tension handle and at least one hinge arm;

a first support arm rod extending outwardly from the first member in a first direction for attachment to said frame;

a second support arm rod extending outwardly from the second member in a second direction for attachment to said frame;

a handle assembly; and a face plate, wherein the face plate is comprised of a plurality of continuous openings positioned in a radial and spaced apart fashion; and wherein the handle assembly is laterally rotatable up to 90 degrees in relation to the face plate.

2. The easel device of claim 1, wherein the first member is spaced apart from the second member when the tensioning apparatus is both in an engaged position and in a disengaged position.

* * * * *